US006684672B2

(12) United States Patent
Hermansson et al.

(10) Patent No.: US 6,684,672 B2
(45) Date of Patent: Feb. 3, 2004

(54) CYLINDER LOCK ARRANGEMENT

(75) Inventors: Stig Hermansson, Kungälv (SE); Helmut Ponn, Torslanda (SE)

(73) Assignee: Volvo Personvagnar AB, Göteborg (SE)

( * ) Notice: Subject to any disclaimer, the term of this patent is extended or adjusted under 35 U.S.C. 154(b) by 0 days.

(21) Appl. No.: 09/876,170

(22) Filed: Jun. 7, 2001

(65) Prior Publication Data

US 2003/0041636 A1 Mar. 6, 2003

Related U.S. Application Data

(63) Continuation of application No. PCT/SE99/02171, filed on Nov. 24, 1999.

(30) Foreign Application Priority Data

Dec. 10, 1998 (SE) ..... 9804325

(51) Int. Cl.[7] ..... G05G 5/00; E05B 13/00

(52) U.S. Cl. ..... 70/379 R; 70/188; 70/189; 70/222; 70/223

(58) Field of Search ..... 70/188, 189, 149, 70/222, 223, 379 R, 379 A, 380, 422, 472

(56) References Cited

U.S. PATENT DOCUMENTS 3,316,742 A 5/1967 Wellekens
4,583,775 A * 4/1986 Bisbing ..... 292/64
5,070,716 A * 12/1991 Whorlow ..... 70/492
5,265,453 A * 11/1993 Konii et al. ..... 70/379 R
5,640,864 A * 6/1997 Miyamoto ..... 70/379 R
5,732,580 A * 3/1998 Garnault et al. ..... 70/422
5,765,417 A * 6/1998 Bolton ..... 70/495
6,021,654 A * 2/2000 McCaa ..... 70/149

FOREIGN PATENT DOCUMENTS

GB 2 005 335 A 4/1979

* cited by examiner

*Primary Examiner*—Lloyd Gall
*Assistant Examiner*—Michael J. Kyle
(74) *Attorney, Agent, or Firm*—Howrey Simon Arnold & White LLP

(57) ABSTRACT

A cylindrical lock arrangement of the kind having a cylindrical housing attached to a door and a lock cylinder with lever tumblers provided to cooperate with a lock device, whereby the lock device is arranged to be actuated via a carrier provided to the cylinder lock. The invention has a connection device for transmission of force from the lock cylinder to the carrier is provided to be axially displaced in relation to the lock cylinder from a neutral position and in direction towards this during rotation of the lock cylinder with a fitting key. The connection device is provided to be brought to an active position in friction engagement with the carrier not until after the axial displacement from the neutral position, after which locking and unlocking respectively of the lock device is performed by further rotation of the lock cylinder by means of the key. The connection device is provided such that during a return movement of the key be displaced back in axial direction to the neutral position, in which the connection device is disengaged form the carrier. The device according to the invention is suitable in vehicle doors as well as house doors.

6 Claims, 4 Drawing Sheets

CYLINDER LOCK ARRANGEMENT

CROSS REFERENCE TO RELATED APPLICATIONS

The present application is a continuation of PCT Application No. PCT/SE99/02171, filed Nov. 24, 1999, which claims priority to Swedish Application No. 9804325-0, filed Dec. 10, 1998.

BACKGROUND OF THE INVENTION

1. Technical Field

The present invention teaches a cylinder lock arrangement. More particularly, the present invention teaches a cylinder lock arrangement comprising a cylinder housing attached to a door and a lock cylinder with lever tumbler provided to cooperate with a lock device, whereby the lock device is affectable via a carrier provided to the cylinder lock.

2. Background Information

In conventional cylinder locks a lock cylinder with lever tumbler is provided in a cylindrical housing, whereby the lever tumblers in locking position extend from the lock cylinder and are in engagement with recesses in the cylindrical housing. In these known locks the lock cylinder is connected to a carrier, which in turn is connected to the lock device.

When a fitting key is inserted in the keyhole the lever tumblers are displaced so that they disengage with the cylindrical housing. The lock cylinder thus becomes rotatable inside the cylindrical housing for operation of the lock device.

If a wrong key or a tool is inserted in the keyhole, the lock cylinder can only be rotated together with the cylindrical housing. Accordingly, by reinforcing the attachment of the cylindrical housing this type of lock can make it more difficult to commit burglaries. However, for vehicle locks it is difficult to provide sufficient reinforcements due to increases in costs and vehicle weight.

It is previously known to provide overload connections in vehicle locks that break the connection between the lock cylinder and the carrier at great torques. These connections intentionally break when somebody violently tries to rotate the lock cylinder without using the right key.

A cylinder lock with overload connection is described in German publication DE 44 10 736 A1. In that lock, the cylindrical housing is displaced in relation to the lock cylinder during overload. This displacement is utilized to break the connection between the lock cylinder and the carrier. The displacement, and thus disconnection of the carrier, remains until the right key is inserted in the lock cylinder.

SUMMARY OF THE INVENTION

The present invention discloses a device that further improves theft protection. In order to accomplish this, the invention provides for a connection device for the transmission of force from a lock cylinder to a carrier. When the lock cylinder is rotated by a fitting key, the connection device is axially displaced from a neutral position relative to the lock cylinder and in the direction of the lock cylinder. Not until after axial displacement from the neutral position is the connection device brought to an active position in friction engagement with the carrier. Locking and unlocking of the lock device may then be respectively performed by further rotation of the lock cylinder by the key. During a return movement of the key, the connection device is brought back in an axial direction to the neutral position. The connection device is then disengaged from the carrier.

An advantage with the device of the present invention is that the lock cylinder, when in the normal position, is always is in engagement with the carrier. Not until the right key is inserted and rotated a distance is the lock cylinder mechanically connected to the carrier.

In known cylinder locks with overload connections, the lock cylinder is initially mechanically connected to the carrier. Compared to the present invention, this increases the possibility of breaking open the lock.

A considerable advantage of the device of the present invention is that a connection device having a friction surface, which is situated on the opposite side of the carrier in relation to the lock cylinder, must be pulled in the direction towards the lock cylinder for connection of the friction resurface to a friction surface on the carrier before the lock device can be actuated via the lock cylinder. Because of this, the lock according to the invention is practically impossible to break open via the keyhole.

Other advantages with the device according to the invention is that the construction of the lock is relatively simple and it does not need to be designed in strong materials and in great dimensions to be theft proof. The device according to the invention can be manufactured in plastics, which makes the lock according to the invention economically advantageous in relation to conventional locks, while also eliminating corrosion problems.

BRIEF DESCRIPTION OF THE DRAWINGS

In the following, the invention will be further described with reference to various embodiments, which are shown in the accompanying drawings, wherein.

DETAILED DESCRIPTION OF THE INVENTION

Figure 1:
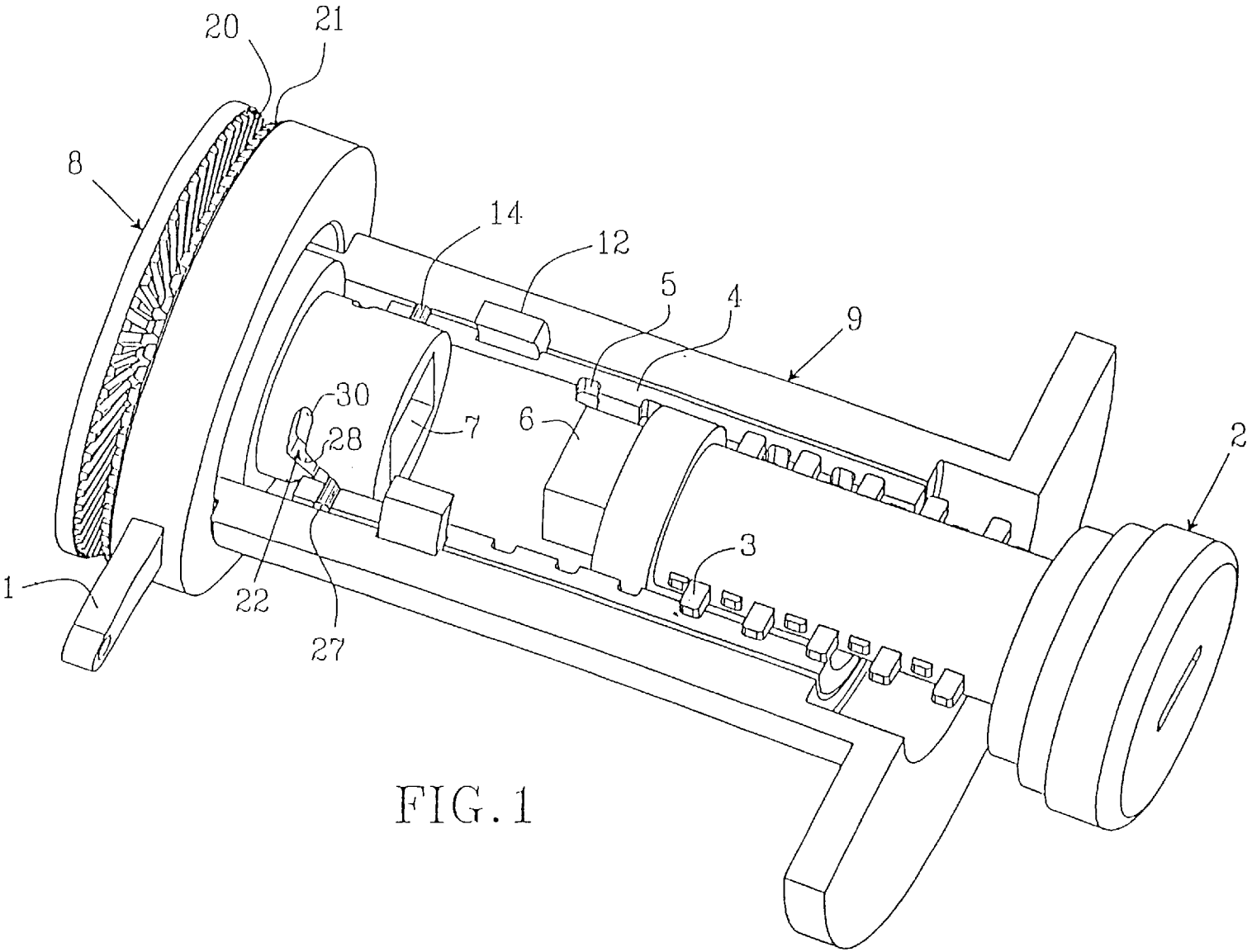
FIG. 1 illustrates a perspective of one embodiment of the present invention wherein a cross-section of the housing and friction connection is provided in order to illustrate the internal components of the device.

In FIG. 1 the cylindrical housing 9 is cut along its entire length so that the details inside can be viewed. The lock device according to the present invention differs from conventional cylinder locks in that the lock cylinder 2 is not in direct connection with the carrier 1. The connection with the carrier 1 is performed via a connection device 8. The carrier 1 is connected to the lock device via its arm 1' in a manner not described herein.

The lock cylinder 2 is shown separated from the connection device 8 in FIG. 1 in order to illustrate the reciprocal connection between the lock cylinder 2 and the connection device 8. The lock cylinder 2 is provided with a square peg 6, which, as the lock cylinder 2 is mounted, is in fixed engagement with a corresponding recess 7 on the connection device 8. This is shown in FIG. 1 in its neutral position, in which the connector or friction means 20 of the connection device 8 is disengaged from the connector or friction means 21 of the carrier 1. As can be seen from FIG. 1, this embodiment of the friction means 20, 21 consist of teeth.

The device according to the invention further comprises a disengagement sleeve 4 provided between the lock cylinder 2 and the cylindrical housing. The disengagement sleeve 4 has one or more recesses 5 for receiving of portions of a respective lever tumbler 3 extending from the lock cylinder. The disengagement sleeve 4 and the cylindrical housing 9 are reciprocally connected by means of a friction connection 12, which is formed as a friction ring in the embodiment shown in FIG. 1. This can be, for example, a rubber ring dimensioned to fix the disengagement sleeve in relation to the cylindrical housing 9. The friction connection 12 should be so fixed at those torques that exist during switching of the lock device from closed to opened position and vice versa when a fitting key is inserted into the lock cylinder 2 and the lever tumblers 3 are disengaged from the recesses 5 on the disengagement sleeve 4. However, the friction connection 12 should permit rotation of the disengagement sleeve 4 together with the lock cylinder 2 when the lever tumblers are engaged with the recesses of the disengagement sleeve and the lock cylinder in this state is violently rotated with a tool or with a non fitting key.

The connection device 8 has a number of guide grooves 22, of which only one is shown in FIG. 1. The guide grooves 22 cooperate with pegs 24, 27 attached in the disengagement sleeve, which are in engagement with the guide grooves 22. A first groove portion 28 extends diagonally over the connection device 8 and changes into a second groove portion 30, which is perpendicular to the longitudinal axis of the connection device 8.

When a fitting key has been inserted in the keyhole and the lever tumblers 3 thereby become disengaged from the recesses 5 on the disengagement sleeve 4, the lock cylinder 2 can be rotated in relation to the disengagement sleeve 4, which is held by the friction means 12. When the lock cylinder 2 according to FIG. 1 is rotated in counter-clockwise direction with a fitting key, the connection device 8 is carried along in the rotational motion, whereby the fixed pegs 24 and 27 in a first rotation step slide in the beveled guide portions 28 and axially displace the connection device 8. The axial extension of the beveled groove corresponds to the axial distance between the friction means 20, 21, so that both of these friction means 20, 21 are in reciprocal engagement when the beveled groove portion has passed the peg 24 and 27 respectively. During continuous rotation of the lock cylinder 2, the pegs 24 and 27 respectively, slide in the groove portions 30 and the carrier 1 is carried along for effecting the lock device from the closed to open position or vice versa.

When the locking motion has been finished and the key is removed, the connection device 8 returns to its normal position disengaged from the carrier 1. If someone uses violence to try to rotate the lock cylinder 2 with a non fitting key or a tool, the disengagement sleeve 4 is carried along in the rotation motion and an axial displacement of the connection device 8 will not occur. During such circumstances, the lock cylinder 2 is not able to effect the lock device because the lock cylinder 2 is not directly connected to the carrier 1 via the connection device 8.

Figure 2:
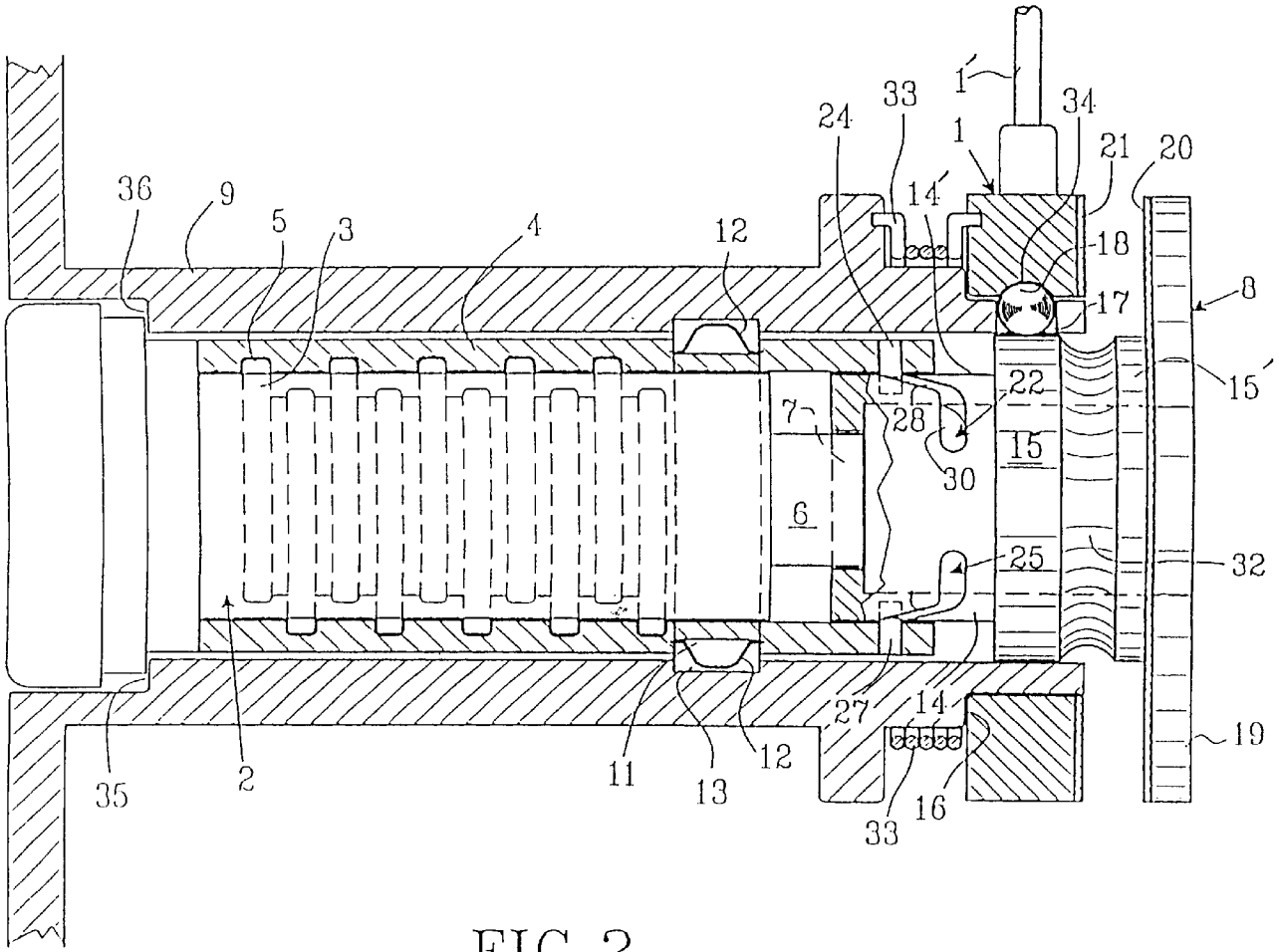
FIG. 2 illustrates a longitudinal cross-sectional view of one embodiment of the invention with the lock in a neutral position, which embodiment is slightly modified compared to the embodiment in FIG. 1.
Figure 3:
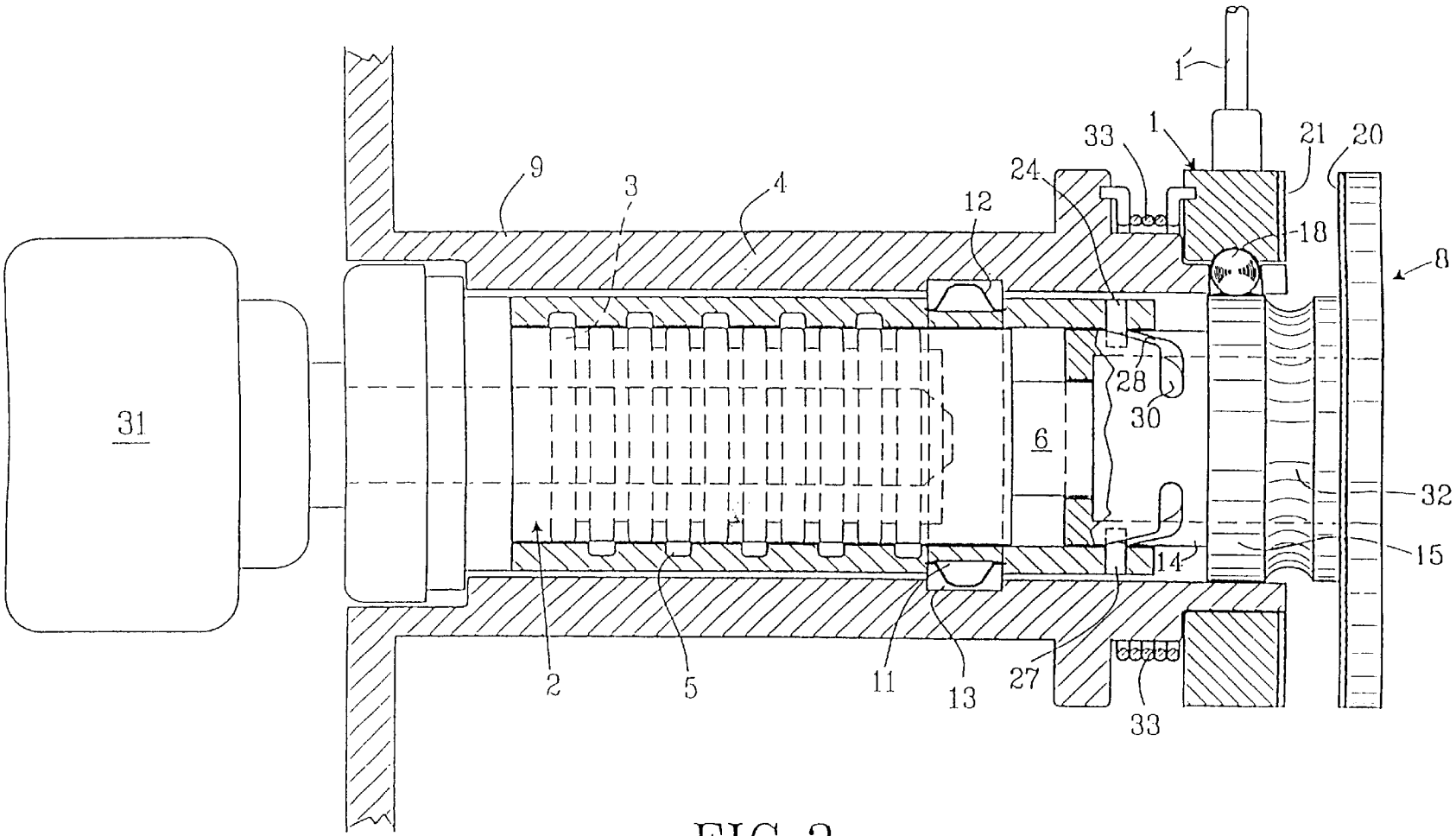
FIG. 3 illustrates the same cross-sectional view as in FIG. 2 but with a fitting key inserted.
Figure 4:
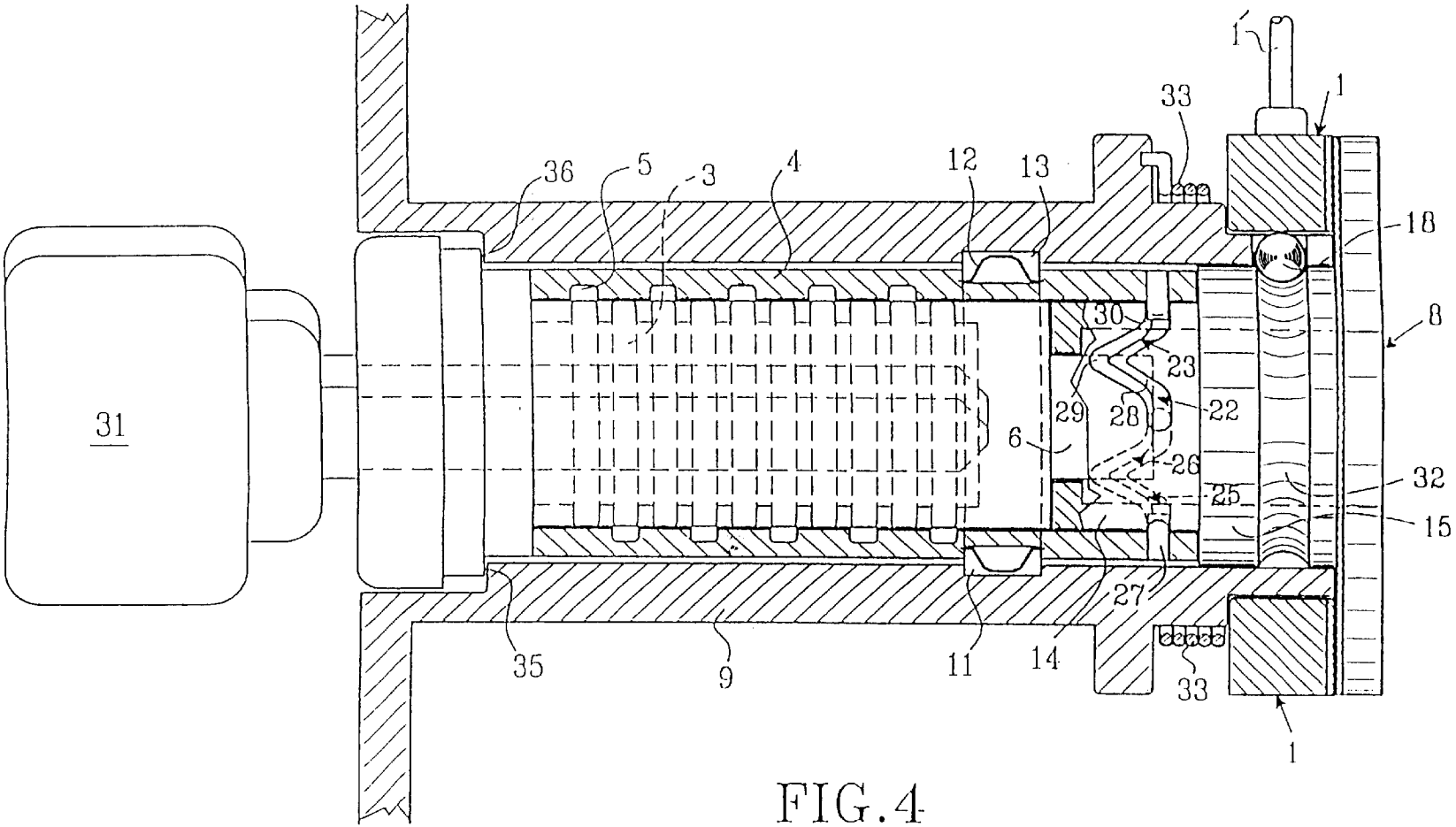
FIG. 4 illustrates the same cross-sectional view as in FIGS. 2 and 3 but with the lock in the active position.

In the embodiment shown in FIG. 2, 3 or 4, the parts corresponding to similar parts in FIG. 1 have been denoted by the same reference numerals.

FIGS. 2, 3 and 4 show one preferred embodiment of a device according to the invention and the connection 1' thereof to a carrier 1, which is connected to a lock device via a linkage or cable 1' in a way not shown. A connection in the form of a cable gives better theft protection than a stiff linkage, because the latter is easier for a thief to displace or bend in the right way with a tool for opening the lock device.

Different known types of lock devices can be used in combination with the device according to the invention. When the lock device itself is not a part of the invention, no special lock device is shown and described.

A lock cylinder 2 with lever tumblers 3 are arranged inside a disengagement sleeve 4. It is provided with recesses 5 for receiving portions of the respective lever tumbler 3 extending from the lock cylinder 2. When no fitting key is inserted in the keyhole of the lock cylinder 2, lever tumbler springs (not shown) provided in the lock cylinder 2 press the respective lever tumbler 3 laterally outwards from the lock cylinder 2 and into engagement with the recesses 5 on the disengagement sleeve 4. This state is shown in FIG. 2.

In FIG. 2, the inner end portion of the lock cylinder 2 consists of a square peg 6 arranged in fixed engagement with a corresponding recess 7 on a connection device 8, whereby it is carried along during rotation of the lock cylinder. The inner of the connection device 8 is open right in front of the square peg 6 so that it is displaceable into the connection device 8 during axially displacement thereof.

The disengagement sleeve 4 is arranged inside a cylindrical housing 9, which is attached to the door 10. The disengagement sleeve 4 and the cylindrical housing 9 are reciprocally connected by means of friction connections 12, which in the shown embodiment are formed from a number of clamps 12 arranged in separate recesses 11 around the periphery of the disengagement sleeve 4. These clamps 12 engage with recesses 13 in the cylindrical housing. The clamps 12 are dimensioned such that they fix the disengagement sleeve 4 relative to the cylindrical housing 9 at torques that occur during switching of the lock device from closed to opened position and vice versa. This occurs when a fitting key is inserted in the lock cylinder 2 disengaging the lever tumblers 3 from the recesses 5 on the disengagement sleeve 4. However, the clamps 12 permit rotation of the disengagement sleeve 4 together with the lock cylinder 2 when the lever tumblers 3, as shown in FIG. 2, are engaged with the recesses of the disengagement sleeve 4 and the lock cylinder 3 in this state is rotated with a tool or with a non-fitting key.

At the recess 7 end of the connection device 8, a first cylindrical portion 14 is provided. This first portion 14 is arranged inside the disengagement sleeve 4 and in the states shown in FIGS. 2 and 3, extends a portion 14' beyond this. In the axial direction of the connection device 8 this portion 14' has an extension which is at least equal to the axial displacement of the connection device 8, which will be described in further detail below. Next to the first cylindrical portion 14, the connection device 8 has a slightly larger second cylindrical portion 15 situated outside the disengagement sleeve 4 and with a first portion inside the cylindrical housing 9. The carrier 1 is arranged around an end portion of the cylindrical housing 9, and laterally bears on a stop 16 of the cylindrical housing. In the state shown in FIGS. 2 and 3, the neutral position of the connection device 8, the second cylindrical portion 15 thereof with said first portion is situated right in front of the carrier 1. The second cylindrical portion 15 of the connection device has a second portion 15', which in the neutral position of the connection device (see FIGS. 2 and 3) is situated in the axial direction outside the cylindrical housing 9. This second portion 15' has an axial extension that corresponds to the axial displacement of the connection device 8.

The cylindrical housing 9 has a through hole 17 directly in front of the carrier 1. The through hole 17 is provided to receive a lock ball 18 having diameter slightly larger than the wall thickness of the cylindrical housing 9 near the hole 17. The second cylindrical portion 15 of the connection device 8 fits in the cylindrical housing 9 and the carrier 1 surrounds, substantially with fit, the end portion of the cylindrical housing 9. The first portion of the second cylindrical portion 15 of the connection device 8, the cylindrical housing 9, the carrier 1 and the lock ball 18 are all dimensioned so that the lock ball 18 is pressed by the first portion on the second cylindrical 15 portion into locking engagement with the carrier 1 for fixing it with the cylindrical housing 9. When the ball 18 presses the carrier 1 upwards, the diametrically opposite portion of the carrier 1, bearing on the outside of the cylindrical housing 9, is also pressed to fix the carrier 1 with the cylindrical housing 9.

The connection device 8 is provided with a collar 19 at the end opposite the recess 7. This collar 19 is situated on the opposite side of the carrier 1 relative to the lock cylinder 2. The collar 19 is provided with friction means 20 on the side facing the carrier 1. This friction means 20 is able to be engaged with the friction means 21 on the carrier 1, thereby forming the connection between the connection device 8 and the carrier 1 for transmission of torques from the lock cylinder 2 to the carrier 1.

As illustrated, the first cylindrical portion 14 has two grooves 22, 23 extending along the periphery of the connection device for locking and unlocking. These grooves 22, 23 cooperate with a first peg 24 attached to the disengagement sleeve 4. The peg 24 is able to engage with the grooves 22, 23. Two further identical grooves 25, 26 corresponding to grooves 22, 23 cooperate with a second peg 27 attached to the disengagement sleeve 4.

A first groove portion 28 of the respective groove 22 extends from a common end position 29 of the grooves 22, 23 and 25, 26, respectively, on the connection device 8 adjacent the end provided with the recess 7 diagonally over the connection device in direction to the other end thereof. Beyond the first beveled groove portion 28, the groove changes into a second groove portion 30, which is perpendicular to the longitudinal axis of the connection device 8. Corresponding end position and groove portions for respective grooves are identical. For the sake of simplicity, these have been denoted with the same reference numerals. In the position shown in FIGS. 2 and 3, also denoted as the neutral position, the two pegs 24, 27 are in the common end position 29 of the two grooves 22, 23 and of the two grooves 25, 26 respectively.

In FIG. 2 no key is inserted in the lock cylinder 2. The lever tumblers 3 are displaced sideways from the lock cylinder 2 by the lever tumbler springs and engaged with the recesses 5 on the disengagement sleeve 4. If a tool or a non-fitting key is inserted in the keyhole and used to try to rotate the lock cylinder when the lock is in the position shown in FIG. 2, a torque must be provided that is so great that the lever tumblers 3 break in order to be able to rotate the lock cylinder 2 in relation to the disengagement sleeve 4. However, as mentioned above, the disengagement sleeve 4 is only connected to the cylinder housing 9 by friction means in the form of clamps 12. These are so dimensioned that the disengagement sleeve 4 is carried along in the rotational motion when the lock cylinder is violently rotated with a tool or non-fitting key, and the lever tumbler 3 is engaged with the disengagement sleeve 4. During rotation of the lock cylinder 3 and the disengagement sleeve 4, the connection device 8 is carried along. However, as the friction means 20 is distant from the friction means 21 of the carrier, the lock device is not affected.

When a fitting key 31 is inserted in the lock cylinder 2, the lever tumblers 3 are disengaged from the recesses 5 and the lock cylinder 2 can be rotated in relation to the disengagement sleeve 4. The sleeve 4 remains fixedly held in the cylindrical housing 9 by means of clamps 12. During rotation of the lock cylinder 2, the connection device 8 is carried along in the rotational motion. In the neutral position shown in FIG. 2, the pegs 24, 27 of the disengagement sleeve 4 are engaged with the grooves 22, 23 and 25, 26 on the connection device 8 and situated in the end position 29. The 24, 27 will slide in the beveled groove portions 28 in relation to the disengagement sleeve 4 during rotation of the connection device 8, whereby the connection device 8 is axially displaced. The axial extension of the beveled groove portions 28 correspond to the distance between the friction means 20 of the connection device 8 and the friction means 21 on the carrier 1, when the connection device 8 is in its neutral position. Thus, when the pegs 24, 27 have passed the beveled groove portions 28, the connection device 8 is actively engaged with the carrier 1. In this position, the connection device 8 ia axially displaced so that a groove 32 provided in the second cylindrical portion 15 is right in front of the key ball 18. This thereby drops down and is disengaged from the carrier 1, which can now rotate. During continuous rotation of the lock cylinder, the pegs 24, 27 run in the groove portions 30 extending perpendicular to the longitudinal axis of the connection device 8. The carrier 1 follows the rotational motion for locking and unlocking respectively of the lock device.

In FIG. 4, a fitting key 31 has been rotated 45 degrees from the position shown in FIG. 3. The connection device 8 has, as described above, been brought to engagement during this motion with the carrier 1 and even rotated it a bit, for example, in locking the lock device. The device also comprises a key bring back spring (not shown). This can for example, be provided between the square peg 6 of the lock cylinder 2 and the disengagement sleeve 4. The spring is tightened when the key 31 is turned for locking or unlocking, and brings back the key 31 and, thus, the lock cylinder 2, to the neutral position of the lock, i.e., with the connection device 8 disengaged from the carrier 1. This key return spring can also be provided to bring back the carrier 1 to its neutral position. However, as illustrated, a special return spring 33 has been provided for the carrier 1. The return spring 33 has its first end attached to the cylindrical housing 9 and its other end to the carrier 1. Further, as illustrated, the carrier is provided with a lock seat in the form of a recess 34 for engagement with the lock ball 18. The neutral position of the carrier 1 is marked by this recess 34, which the lock ball 18 fills thereby fixing the carrier 1.

When the lock pegs 24, 27 are in the end position of the grooves 29, i.e., when the connection device 8 is in its neutral position and disengaged from the carrier 1, the lock cylinder 2 can be rotated in opposite rotation directions for locking and unlocking the lock device, whereby the peg 24 is displaced along the beveled groove portion 28 in groove 22 and groove 23, respectively, and the peg 27 correspondingly in groove 25 and groove 26, respectively.

Since the parts of the lock device are proportionately simple in construction and do not need to be designed in special materials which can withstand high load stresses so that the lock is theft proof, different parts of the lock can be made of plastics. This is economically advantageous and eliminates problems with corrosion. The lock cylinder 2 is provided with a flange 35 that which rests against a stop 36 on the cylindrical housing 9, thereby preventing the cylinder lock and connection device 8 from being damaged due to violence so that the carrier 1 can be reached. This protection can be further reinforced by providing a stop (not shown) in the lock construction behind the connection device 8. The stop bears on the connection device when it is in the neutral position, thereby preventing further displacement of the connection device in direction from the carrier 1.

The invention is not limited to the above described embodiments, but several modifications are possible within the scope of the subsequent claims. For example, the pegs 24, 27 can be replaced by one hypothetical guide through peg. Of course, the friction connection between the disengagement sleeve 4 and the cylindrical housing 9 do not need to consist of a number of clamps 12, but can be met by other suitable friction means on the disengagement sleeve 4 and/or on the cylindrical housing 9. The friction means 20, 21 on the collar of the connection device 8 and on the carrier 1 may be comprised of Velcro tape. In another embodiment, both surfaces can be provided with abrasive paper to create the friction necessary between the connection device 8 and the carrier 1. Another suitable way to achieve necessary friction grip is to machine the surfaces forming teeth or channels or other surface irregularities, for example, such as the surfaces of a rasp or file. Of course, the device according to the invention is not limited to cylinder locks to vehicles, but is also suitable for use in locks in house doors. Accordingly, the invention is not limited to the embodiments described above and illustrated in the figures, but can be modified within the scope of the following claims.

What is claimed is:

1. A cylinder lock arrangement having a cylindrical housing attached to a door and a lock cylinder with lever tumblers provided to cooperate with a lock device, whereby the lock device is arranged to be actuated via a carrier provided to the cylinder lock, comprising:

a connection device for transmission of force from the lock cylinder to the carrier having a carrier friction means on the opposite side of the carrier in relation to the lock cylinder and provided to be axially displaced in relation to the lock cylinder from a neutral position and in direction towards the carrier during rotation of the lock cylinder with a fitting key, wherein the connection device is provided to be brought to an active position in friction engagement with the carrier not until after said axial displacement from the neutral position, after which locking and unlocking respectively of the lock device is performed by further rotation of the lock cylinder by means of the fitting key, wherein the lock cylinder has an inner non-circular end portion provided in fixed engagement with a corresponding recess on the connection device whereby it is carried along at rotation of the lock cylinder, wherein the end of the connection device which is provided with said recess has a first cylindrical portion provided inside the disengagement sleeve and extending beyond this in direction from the lock cylinder a distance which is at least as long as said axial displacement from the neutral position to the active position, further wherein the connection device during return movement of the fitting key is provided to be brought back in axial direction to the neutral position, wherein the connection device is disengaged from the carrier, wherein the carrier is provided on the cylindrical housing at one of the inner ends thereof, a disengagement sleeve provided with recesses intended to receive portions of the respective lever tumblers and is arranged around the lock cylinder and inside the cylindrical housing, wherein the disengagement sleeve and the cylindrical housing are interconnected by means of a friction connection arranged to arrest the disengagement sleeve in relation to the cylindrical housing at torques that occur during switching of the lock device from closed to open position and vice versa via the carrier when the fitting key is inserted into the lock cylinder and the lever, tumblers are disengaged from said recesses on the disengagement sleeve, and which is provided, to permit rotation of the disengagement sleeve together with the lock cylinder in this state is brought to rotate, wherein the connection device is provided to stay in the neutral position when the disengagement sleeve is carried in rotation by the rotation of the lock cylinder, whereby unlocking of the lock device is prevented, wherein a collar is provided on the end of the connection device opposite in relation to the recess, said collar being situated on the opposite side of the carrier in relation to the lock cylinder and having a collar friction means on the side facing the carrier, wherein the collar in the neutral position of the connection device is situated at a distance from the carrier and is intended to be brought in engagement with its collar friction means with said corresponding carrier friction means after said axial displacement of the connection device from the neutral position to the active position, wherein the first cylindrical portion of the connection device has at least two grooves extending along the periphery of the connection device, one for locking and one for unlocking, said grooves cooperating with at least one peg attached to the disengagement sleeve, said peg in engagement with the grooves, a first groove portion of the respective grooves extends from a common end position of the grooves on the connection device near the end provided with a recess obliquely over the connection device in direction toward the second end thereof and wherein the respective groove changes into a second groove portion perpendicular to the longitudinal axis of the connection device, whereby the connection device, during rotation of the lock cylinder with the fitting key inside the disengagement sleeve, is axially displaced when said peg runs in the first groove portion of the respective grooves, wherein an axial extension of the first groove portion corresponds to the distance from the collar friction means to the carrier friction means in the neutral position of the connection device, and whereby the connection device is displaced from the neutral position to an active position when the peg on the disengagement sleeve runs from the end position of the first groove portion to the second groove portion and whereby the carrier at further rotation of the lock cylinder with the peg running through the second groove portion is carried along for locking and unlocking respectively of the locking device.

2. Arrangement according to claim 1 wherein the connection device has a second cylindrical portion close to the first cylindrical portion situated outside the disengagement sleeve with a first portion inside the cylindrical housing, said second portion in the neutral position of the connection device being situated with said first portion right in front of the carrier, wherein the second cylindrical portion of the connection device has a second portion which in the neutral position of the connection device is situated in an axial direction outside the cylindrical housing, and which has an axial extension corresponding to said axial displacement of the connection device, the cylindrical housing in front of the carrier having a through hole provided for receiving a lock ball, the diameter of which is larger than the wall thickness of the cylindrical housing near the hole, the second cylindrical portion of the connection device being provided to fit into the cylindrical housing, the carrier surrounding the cylindrical housing substantially with fit, the first part of the second cylindrical portion of the connection device, the cylindrical housing, the carrier and the lock ball being dimensioned so that the lock ball in the neutral position of the connection device is pressed by the first part of the second cylindrical portion to locking engagement with the carrier for keeping on the cylindrical housing, and the second part of the second cylindrical portion having substantially the same outer diameter as the first part of the second cylindrical portion and being provided with a groove provided for receiving a portion of the lock ball, whereby the lock ball after displacement of the connection device from the neutral position to the active position partly falls down into the groove disengaging the lock ball from engagement with the carrier so that the carrier can be rotated around the cylindrical housing.

3. Arrangement according to claim 2 wherein the carrier has a lock seat for receiving a part of the lock ball when the carrier is in a neutral position and the connection device is in its neutral position.

4. Arrangement according to claim 1 wherein the collar friction means and the carrier friction means are comprised of Velcro tape.

5. Arrangement according to claim 1 wherein the collar friction means and the carrier friction means are comprised of abrasive paper.

6. Arrangement according to claim 1 wherein the collar friction means and the carrier friction means are formed by shaping the contact surfaces for forming of teeth, channels or other surface irregularities.

* * * * *